United States Patent [19]

Zöls

[11] Patent Number: 4,773,247

[45] Date of Patent: Sep. 27, 1988

[54] APPARATUS FOR FORMING A BULGE IN A STRANDED STEEL WIRE CABLE

[75] Inventor: Josef Zöls, Unterschleissheim, Fed. Rep. of Germany

[73] Assignee: Dyckerhoff & Widmann Aktiengesellschaft, Munich, Fed. Rep. of Germany

[21] Appl. No.: 923,314

[22] Filed: Oct. 27, 1986

[30] Foreign Application Priority Data

Nov. 2, 1985 [DE] Fed. Rep. of Germany ..... 3538919

[51] Int. Cl.[4] ..... B21D 7/00; B21F 7/00

[52] U.S. Cl. ..... 72/315; 72/318; 29/461

[58] Field of Search ..... 72/311–315, 72/318, 357; 269/228, 217; 140/105, 106; 254/29 R, 31, 254, 259; 226/163; 29/461

[56] References Cited

U.S. PATENT DOCUMENTS

| | | | |
|---|---|---|---|
| 406,552 | 7/1889 | Webster | 72/318 |
| 1,272,176 | 7/1918 | Alexander | 269/228 |
| 3,824,653 | 7/1974 | Sholler | 254/254 |
| 4,237,942 | 12/1980 | Dietrich | 72/318 |
| 4,469,756 | 9/1984 | Jungwirth et al. | 140/105 |

FOREIGN PATENT DOCUMENTS 3207957 9/1983 Fed. Rep. of Germany .

*Primary Examiner*—Daniel C. Crane

*Attorney, Agent, or Firm*—Toren, McGeady & Associates

[57] ABSTRACT

An apparatus for forming a radially outwardly directed bulge in an axially extending stranded steel wire cable for use as an anchor in a concrete structural component includes a frame with a pair of side walls. A clamping device is mounted on one end of the frame for gripping the stranded cable. The clamping device has two displaceable clamping jaws connected to counter jaws by articulated levers for moving the clamping jaws into the closed or clamped position. The clamping jaws are closed by a piston-cylinder unit mounted in the frame. Spaced from the clamping device on the frame is a sliding carriage with a thrust member into which one end of the stranded cable is inserted. The sliding carriage is connected to the piston-cylinder unit. After the clamping device is closed, the sliding carriage and thrust member are moved toward the clamping device by the piston-cylinder unit and the individual wires of the stranded cable are displaced axially and radially outwardly into a radially extending bulge against the inside surface of an upsetting pipe located between the clamping device and the thrust member.

13 Claims, 3 Drawing Sheets

APPARATUS FOR FORMING A BULGE IN A STRANDED STEEL WIRE CABLE

BACKGROUND OF THE INVENTION

The present invention is directed to an apparatus for forming a bulge in a stranded steel wire cable for use as an anchor in a concrete structural component. In forming the bulge, the cable is axially upset from one end over a portion of its axial length with the individual wires being deformed axially and spread radially outwardly. The apparatus includes an elongated frame with a clamping device at one end including a pair of clamping jaws and a thrust member at the other end. A piston-cylinder unit contacts the clamping device and is connected to the thrust member for effecting the axial displacement of the stranded cable. An upsetting pipe is located between the thrust member and the clamping device and is displaceable in the long direction of the frame. The thrust member and the upsetting pipe include means for affording rotation of the stranded cable during the upsetting operation.

In addition to steel rods, steel wires and steel wire cables, high strength stranded steel wire cables have been used increasingly in recent years as reinforcing elements, particularly in prestressed concrete. Such stranded cables include a central wire around which outer wires are wrapped in a symmetrical manner with regard to the central wire. In some instances, the stranded cable may include two annular layers of outer wires. The outer wires are twisted or wrapped as in a wire rope.

When such stranded cables are used as prestressing members or tendons, generally they are anchored by wedges. Wedge anchors are relatively costly in view of the material used as well as the time required for installation. Such costs are especially significant when the anchor is to be set in a concrete structural component in a fixed manner, that is, when the prestressing member is not required to be tensioned at the location of the anchorage. Moreover, it is difficult to obtain sufficient fatigue strength when using wedge anchors without employing additional measures.

For the fixed anchorage of stranded cables, that is, an anchorage which cannot be tensioned, it has been known to upset a stranded cable at one end by applying pressure so that the individual wires, while deforming in a plastic manner, form a bulge which can be embedded in a concrete structural component for anchoring the stranded cable. To produce such a bulge, an apparatus is known in which the bulge is formed along at least a part of its length with the maximum outside diameter located within an upsetting pipe extending coaxially relative to the stranded cable axis whereby the individual wires of the cable bear against the inside wall of the upsetting pipe during the formation of the bulge so that the wires unwind, note DE-OS 32 07 957 and corresponding U.S. Pat. No. 4,469,756. In this manner, a uniform, gradually increasing spatial curvature of the individual wires of the stranded cable can be achieved with a particularly large number of deflection angles affording an anchorage with a short axial length and very good fatigue behavior.

One problem in such upsetting apparatus is the clamping device used to hold the stranded cable during the upsetting operation. If clamping jaws are used, they are hydraulically driven making the apparatus, as a whole, very costly and cumbersome. The clamping force can be developed in a simpler manner by using wedges. If wedges are used for holding the stranded cable, however, they must be provided with teeth on their inside surfaces for producing the required clamping force. There is the risk that the teeth will cut into the surface of the stranded cable and damage its wires.

SUMMARY OF THE INVENTION

Therefore, it is the primary object of the present invention to provide an apparatus of the type described above which enables the clamping or gripping of the stranded cable to be carried out effectively by clamping jaws without damage to the cable. The clamping force is produced as simply as with wedges, and the clamping pressure is adjustable in a defined manner without any requirement for special devices or operations necessary for removing the stranded cable in which the bulge has been formed. Furthermore, the apparatus is space saving, easy to transport and to operate.

In accordance with the present invention, the apparatus is formed by a frame with a pair of laterally spaced side walls with the clamping device mounted on one end of the frame. A sliding carriage is displaceable on the other end of the frame and supports a thrust member. A piston-cylinder unit is attached to the sliding carriage and is engageable with the clamping jaws for guiding the clamping jaws parallel to fixed counter jaws by means of articulated or toggle levers for moving the clamping jaws into the closed or clamping position. A two-armed lever is located between the piston-cylinder unit and the clamping jaws with one end of the lever arranged to bear against one end of the clamping jaws so that the lever can be pivoted by the piston-cylinder unit.

Sliding guides for the displacement of the sliding carriage can be formed as sliding rails. Preferably, the sliding carriage is displaceable between the side walls of the frame and overlaps the sliding guides.

By guiding the clamping jaws for parallel movement by means of the articulated levers arranged in rows, the clamping jaws can be displaced uniformly into contact with the stranded cable whereby the cable is securely held in friction-locking engagement. With the use of the pivotally connected or articulated levers for producing the clamping force on the stranded cable, there is the further advantage that the clamping force increases as the wear of the articulated levers and the other movable parts increase. As a result, increasing wear does not cause any loss of clamping ability, rather with increasing wear the functioning of the apparatus increases. Since the clamping jaws are closed by the piston-cylinder unit which can be acted upon in two directions, the clamping jaws can open automatically when the piston travels into the initial position and the stranded cable with the bulge can be lifted out of the apparatus without any additional manipulation.

The removal of the stranded cable with the bulge is facilitated if the upsetting pipe is moved as far as possible away from the clamping apparatus. The movement of the upsetting pipe in the elongated direction of the frame away from the clamping apparatus is afforded by a longitudinal slot formed in the side walls. A sliding device for the upsetting pipe is guided in the slot in the manner of a connecting link. If there is a friction-locking engagement between the sliding device and the sliding carriage, the upsetting pipe along with the sliding carriage is automatically moved away from the clamping device when the piston-cylinder unit moves the carriage away from the clamping device.

Preferably, the clamping device is provided with an adjustable stop for the clamping jaws. With the proper adjustment of the stop relative to the length of the articulated levers, the clamping force can be finely proportioned with the stranded cable being secured without any risk of damage to the surfaces of the wires forming the cable.

A mechanism for opening the clamping jaws can be incorporated into the clamping device for returning the jaws into the opened position after the upsetting operation has been completed. Preferably, the opening mechanism involves a spring element, such as a pressure spring, which displaces the clamping jaws into the opened position in cooperation with a pin.

To transmit the clamping force over the articulated levers in a positive manner and avoiding any damage to cable wires, the clamping jaws and the cooperating counter jaws each have circular arc-shaped recesses in supporting contact with the articulated levers and the ends of the levers engaging in the recesses are configured in a circular arc-shaped manner. Accordingly, considerably higher forces can be transmitted than if the support were only effected by means of axial pins, which pins can be used, however, such pins only serve to pivot the clamping jaws back into the initial position and for the captive support of the clamping device parts in the opened condition.

Preferably, the thrust member includes a borehole for receiving the central wire of the stranded cable with the depth of the borehole being adjustable. A set screw can be provided for adjusting the depth of the borehole.

A holder with a handle and a base, attached to the side walls of the frame and to a base plate affords reinforcement for the frame in the region of the longitudinal slot and also serves for easier handling of the apparatus.

For a better understanding of the present invention, reference is made to the following description and accompanying drawings, while the scope of the present invention will be pointed out in the appended claims.

DETAILED DESCRIPTION OF THE INVENTION

Figure 1:
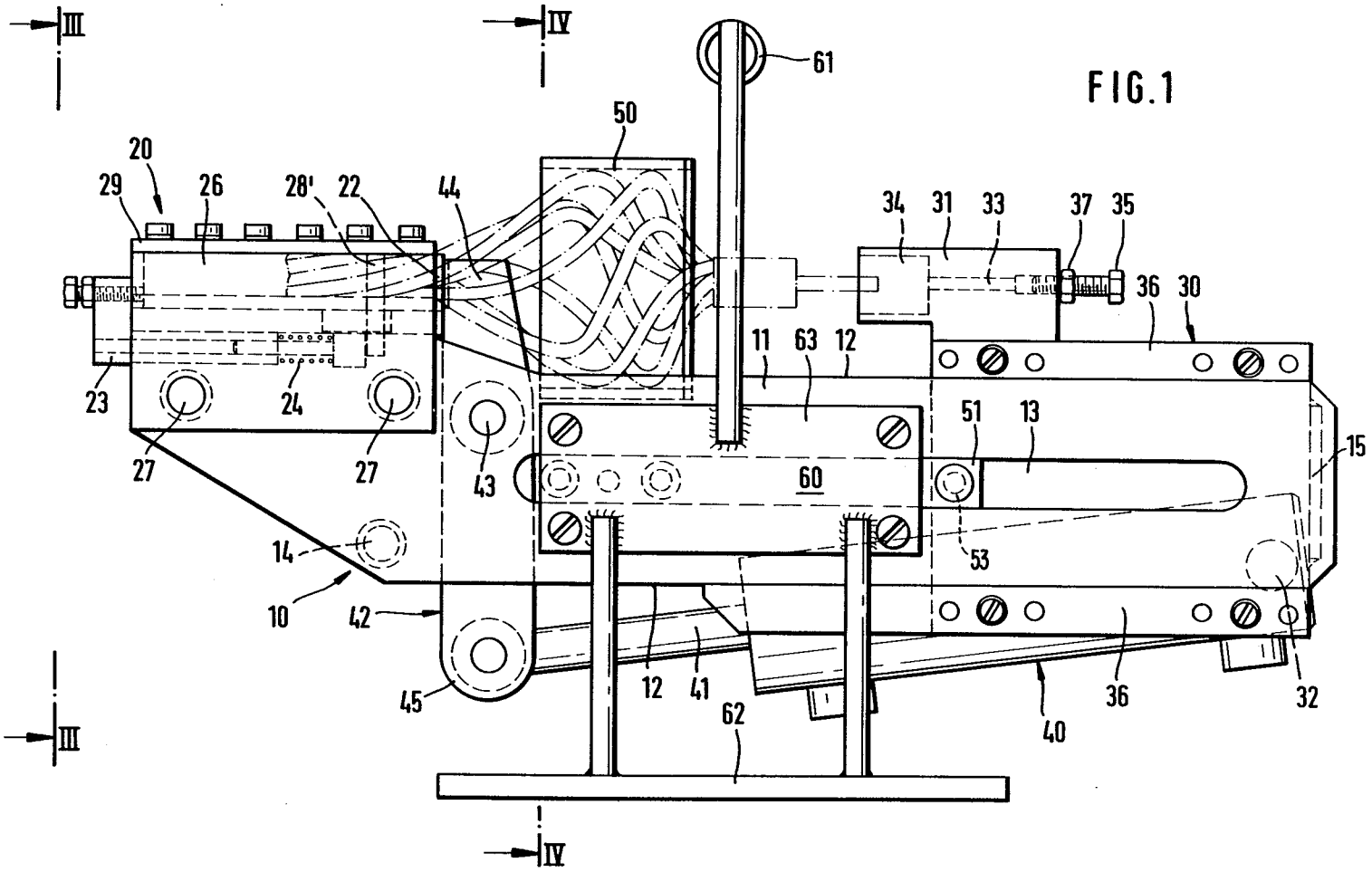
FIG. 1 is a side elevational view of the apparatus embodying the present invention.

FIG. 1 is an elevational side view of the apparatus embodying the present invention. The apparatus is used to form a bulge in an axially extending stranded steel wire cable with the bulge being shown in dot-dashed lines in FIG. 1. The apparatus includes an elongated frame 10 with the elongated direction extending left to right in FIG. 1. Frame 10 has a pair of laterally spaced parallel side walls 11 extending in the elongated direction and connected to one another adjacent the left or first end by a transverse connecting pipe 14 and at the right or second end by a plate 15 extending transversely of the elongated direction. Intermediate the first and second ends of the side walls 11, there is a holder 60 including plates 63 attached by bolts to the outsides of the side plates 11 with a handle 61 projecting upwardly from the plates 63. In addition, a base 62 is attached to the plates 63 and extends downwardly below the side walls 11.

In FIG. 1, a clamping device 20 is secured to the side walls 11 by bolts 27 extending through both of the side walls. The clamping apparatus includes a pair of clamping jaws 22 extending in the elongated direction of the frame. The attachments of the clamping device 20 by means of the bolts 27 affords the possibiity of using different cables and being able to replace the entire clamping device 20 in the event of any possible damage or contamination. The mechanism for opening the clamping jaws is made up of a pair of pressure springs 24 extending in the elongated direction of the frame with each spring bearing against a different pin 28' with the pins each fastened to a different one of the clamping jaws, note the indication of the pins in dashed lines in the clamping device 20. The arrangement and operation of the clamping device is explained in more detail below with the aid of FIG. 2.

Sliding guides 12 are provided along the opposite edges of the side walls 11 extending in the elongated direction of the frame. A sliding carriage 30 is located between the side walls 11 and is displaceable along the sliding guides 12 in the direction between the first and second ends of the frame. The sliding guides 12 can be formed on the side walls 11 or they can be provided as special sliding rails fastened on the edges of the side walls extending in the direction between the first and second ends of the frame. Sliding carriage 30 has outwardly projecting slide ledges 36 which overlap and bear against the upper and lower sliding guides 12.

A thrust member 31 is secured on the sliding carriage and is used for applying axial pressure to the stranded cable for upsetting the cable in the long direction of the frame for forming the radially outwardly extending bulge, as illustrated in FIG. 1. Thrust member 31 has a blind borehole 34 in its end facing toward the clamping device 20. The end of the strand held within a sleeve is inserted into the blind borehole 34. A central borehole 33 extends from the base of the blind borehole 34 toward the second end of the frame. The central borehole 33 has a smaller diameter than the blind borehole and is arranged to receive the central wire of the stranded cable during the upsetting operation. The depth or axial length of the central borehole 33 from the base of the borehole 34 toward the end of the thrust member 31 closer to the second end of the frame can be adjusted as required by an adjusting or set screw 35 with a counter nut 37.

A double acting piston-cylinder unit 40 is located on the lower side of the frame 10 and includes a piston rod 41 connected to one end 45 of a two-armed lever 42 extending upwardly from the end of the piston rod. The piston-cylinder unit is pivotally connected to the underside of the sliding carriage 30 by an axle 32 shown in dashed lines in FIG. 1 adjacent the second end of the frame 10. Lever 42 is pivotally supported intermediate its end between the side walls 11 by an axle 43. Lever 42 has an upper end 44 at its end opposite the piston rod 41 and the upper end is arranged to bear against the end surfaces of the clamping jaws 22 spaced more remotely from the first end of the frame. Transversely extending connecting pipe 14 also serves as a stop for limiting the pivotal movement of the lever 42 to the extent that it is not limited by the stroke of the piston-cylinder unit 40.

Each side wall 11 of the frame 10 has an elongated slot 13 extending in the elongated direction of the frame. A sliding device 51 to which an upsetting pipe 50 is fastened is movably guided in the elongated slot 13 in the manner of a connecting link. There is a friction-locking engagement between the sliding device 51 and the sliding carriage 30, both of which are movable relative to the side walls 11 and also relative to one another. The friction-locking engagement provides that the sliding carriage 30 carries the sliding device 51 and the upsetting pipe 50 with it when it returns into the initial or starting position as shown in FIG. 1 after the production of a bulge in the stranded cable. It is also possible, however, to slide the upsetting pipe 50 back into the starting position by hand.

Figure 2:
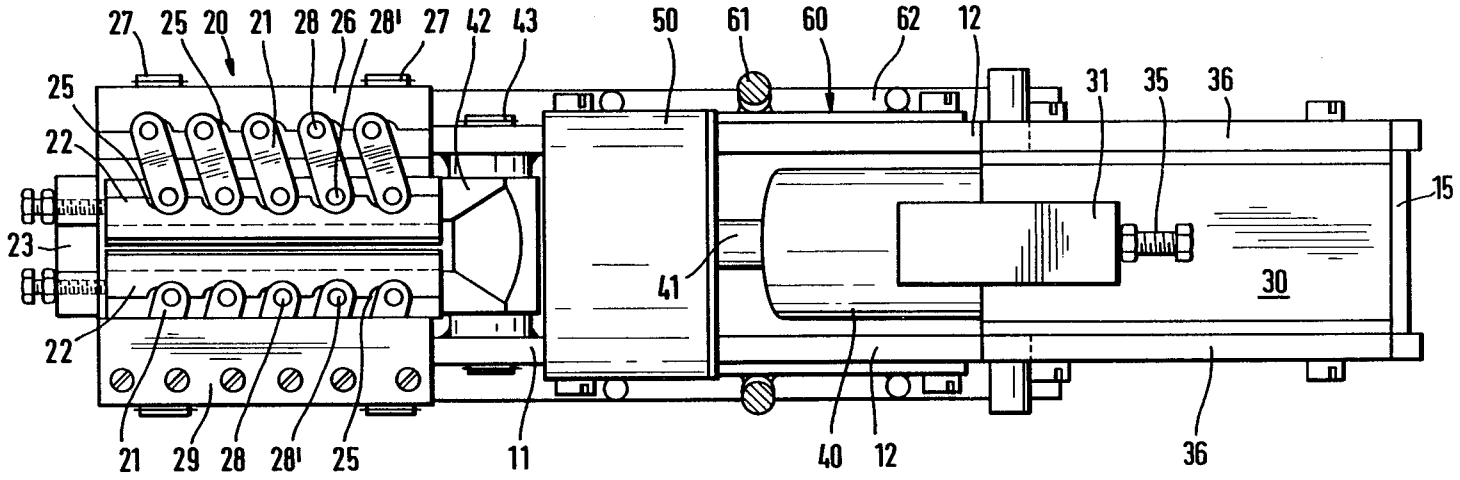
FIG. 2 is a plan view of the apparatus shown in FIG. 1.

The arrangement and operation of the clamping device 20 will be explained with the aid of the plan view provided in FIG. 2. Each of the two movable clamping jaws 22 is pivotally supported against a fixed counter jaw 26 by a plurality of articulated levers 21 which are disposed in a row parallel to one another. In other words, each clamping jaw 22 is supported by a row of levers 21 with an associated counter jaw 26. Each of the clamping jaws 22 and the counter jaws 26 have circular arc-shaped recesses 25 in which the similarly shaped ends of the articulated levers 21 fit in bearing contact. The clamping forces are very great as a result of the arrangement of the articulating levers being approximately perpendicular to the elongated direction of the clamping jaws. The clamping forces, however, can be regulated to avoid any damage to the wires forming the stranded cable. Axial pins 28 serve only to pivot the articulated levers relative to the clamping jaws 22 and the counter jaws 26 and for effecting the opening movement of the clamping jaws.

The closing movement of the clamping jaws 22 is limited by an adjustable stop 23 located at the first end of the frame. The clamping force acting transversely relative to the axial direction of the stranded cable can be exactly proportioned so that the cable is prevented from slipping through the clamping device and also to assure that any damage to the wires of the cable is prevented because of excessive clamping pressure.

The articulated levers 21 are covered, as much as possible, by sheet metal covers 29 to prevent dirt or other contaminants from reaching the levers, to prevent any risk of injury, and to prevent the articulated levers 21 from falling out.

The clamping force required for clamping the stranded cable is generated by driving the piston into the piston-cylinder 40 and is transmitted to the clamping jaws 22 via the two-armed lever 42 pivotally mounted between the side walls 11. The upper end 44 of the lever 42 contacts the ends of the clamping jaws 22 as an axially directed force. The lever ratios are selected so that the clamping jaws 22 are closed against the stranded cable at the commencement of the upsetting cycle until the ends of the clamping jaws at the opposite ends from the end 44 of the lever 42 strike against the stop 23. Only after the clamping action is completed is the sliding carriage 30, which is retained in position in the axial direction by the stiffness of the stranded cale, moved toward the clamping device with the thrust member 31 pressing the cable in the axial direction and causing the bulging action of the individual wires forming the cable.

Figure 3:
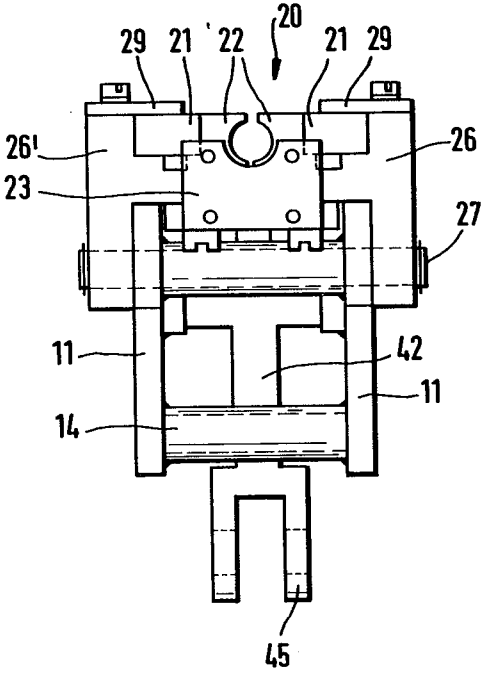
FIG. 3 is an elevational end view of the apparatus taken along the line III—III in FIG. 1.

In FIG. 3, an elevational view is shown of the first end of the apparatus including the clamping device 20. The facing surfaces of the two clamping jaws 22 have semi-circular recesses arranged to receive the stranded cable to be upset. Extending between the side walls 11 of the frame 10 is the transversely extending connecting pipe 14 which serves to interconnect the two side walls and, at the same time, to act as a stop for the movement of the lever 42 when the clamping device 20 is opened following the formation of the bulge in the cable. The lower end 45 of the lever 42 is fork-shaped and is connected in an articulated manner to the piston rod 41. In FIG. 3, the piston rod, the piston-cylinder unit, the upsetting pipe and the holder are omitted for the sake of clarity.

Figure 4:
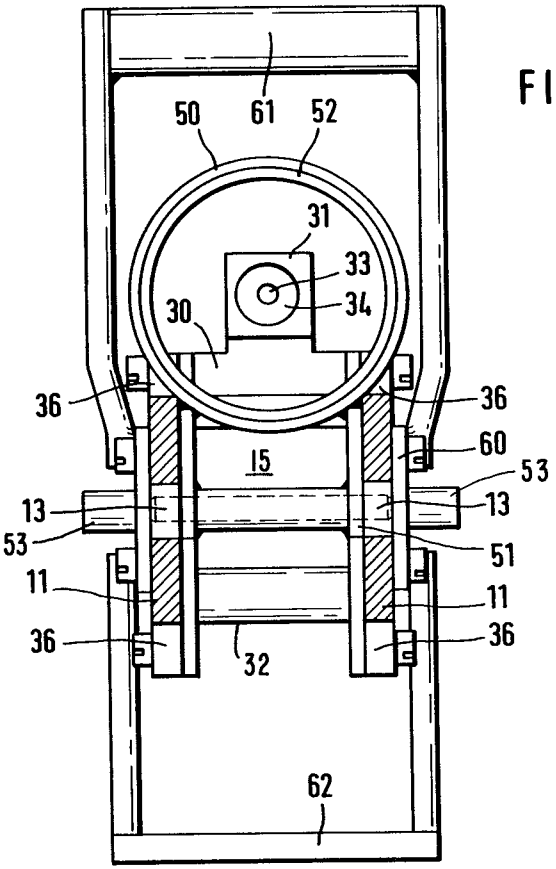
FIG. 4 is a sectional view through the apparatus taken along the line IV—IV in FIG. 1.

FIG. 4 affords a sectional view taken along the IV—IV in FIG. 1. Holder 60 with the plate 63, the base 62 and the handle 61 secured to the outer sides of the side walls 11 can be noted. Sliding carriage 30, with its axle which is secured to the piston-cylinder unit 40, is located between the side walls and extends outwardly or overlaps the upper and lower edges of the side walls by means of the outwardly extending slide rails 36. Upsetting pipe 50, with a rotatable inner pipe 52, is also shown in axial alignment with the thrust member 31. As can be noted, the blind borehole 34 and the central borehole 33 in the thrust member 31 are in axial alignment with the upsetting pipe 50.

To produce a bulge in a stranded cable, the end of the cable is inserted from above between the clamping jaws 22 of the clamping device 20 which are held in the opened position by the springs 24 with the piston rod 41 displaced out of the piston-cylinder unit 40. The end of the cable enclosed in a sleeve is inserted into the blind borehole 34 in the thrust member 31. Next, the piston rod 41 of the piston-cylinder unit 40 is driven into the unit, whereby the upper end 44 of the lever 42 bears against the adjacent end surfaces of the clamping jaws 22 and displaces the jaws in the direction of the stop 23. Due to the arrangement of the articulated levers 21 extending between the clamping jaws and the fixed counter jaws, the clamping jaws move toward one another due to the pivoting action of the levers 21 and the clamping jaws securely grip the stranded cable and clamp it in an immovable position and hold it free of any damage. The clamping pressure on the stranded cable is kept low due to the selection of the length of the clamping jaws in the elongated direction of the frame and of the articulated levers 21, as well as by adjusting the stop 23. At this point, the upsetting pipe 50 is located at its left stop, as shown in FIG. 1, or at least adjacent the stop.

As the piston rod 41 continues its inward movement, the sliding carriage 30 along with the thrust member 31 is displaced toward the clamping device 20. As a result, the cable is exposed to axially upsetting pressure so that the individual wires move axially and radially outwardly. In the radially outward movement, the individual wires contact the inside surface of the upsetting pipe 50, that is, the inside surface of the rotatable inner pipe 52 and receive the desired permanent shape of the bulge during the continuance of the axially upsetting movement of the thrust member.

After the formation of the bulge, the movement direction of the piston rod 41 is reversed and is displaced out of the piston-cylinder unit, whereby the sliding carriage is moved back toward the first end of the frame 10. At this point in the operation of the apparatus, the finished bulge is displayed in dot-dashed lines in FIG. 1. Since there is a friction-locking engagement between the sliding device 51 including the upsetting pipe 50 and the sliding carriage 30, the sliding device 51 is also moved along with the sliding carriage 30. It is possible, as mentioned above, that the upsetting pipe can also be returned to the starting position by moving it manually.

Inasmuch as the stroke of the piston-cylinder unit 40 does not define the path of the two-armed lever 42 in advance, the lever comes to rest at the connecting pipe 14. Accordingly, the closing pressure acting on the clamping jaws 22 is released and the jaws move to the opened position due to the action of the springs 24 forming the opening mechanism. The deformed strand, with its bulge, can be lifted out of the top of the apparatus in a simple manner.

Before commencing the next cable upsetting operation, only the upsetting pipe need be returned manually to the stop adjacent the clamping device. All of the other operations take place automatically and are controlled by the piston-cylinder unit 40, as shown.

While specific embodiments of the invention have been shown and described in detail to illustrate the application of the inventive principles, it will be understood that the invention may be embodied otherwise without departing from such principles.

I claim:

1. Apparatus for forming a bulge adjacent one end of an axially extending stranded steel wire cable made up of a plurality of individual wires for use as an anchor in a concrete structural component, where the stranded wire cable is axially upset adjacent the one end thereof over an axially extending length for deforming the individual wires of the stranded cable into a radially outwardly extending bulge relative to the axis of the cable, comprising a frame elongated in a first direction and having a first end and a second end spaced apart in the first direction, a clamping device including two clamping jaws mounted on said frame adjacent the first end thereof and a thrust member displaceably mounted adjacent the second end of said frame for movement in the first direction toward and away from said clamping device, a piston-cylinder unit positioned on said frame for moving the thrust member in the first direction, an upsetting pipe located between said clamping device and said thrust member and being displaceable in the first direction, means in said thrust member and said upsetting pipe for affording rotation of the stranded cable about the axis thereof extending in the first direction during the upsetting operation, said frame comprises a pair of laterally spaced side walls extending in the first direction between the first and second ends of said frame, said clamping device being supported on said side walls, a sliding carriage displaceably mounted in said side walls for movement in the first direction, said thrust member is secured on said sliding carriage for movement therewith, said piston-cylinder unit is secured to said sliding carriage for effecting the displacement thereof in the first direction, a separate counter jaw associated with each of said clamping jaws, said clamping jaws and counter jaws extending in the first direction and in generally parallel relation with one another, a plurality of articulated levers for each said clamping jaw and the associated said counter jaw with said levers extending transversely of and in contact with said clamping jaw and with the associated said counter jaw whereby said clamping jaws are displaceable in parallel relation to said counter jaws, an elongated lever is pivotally supported on said frame and has a first end connected to said piston-cylinder unit and a second end spaced in the elongated direction of the lever from the first end thereof and arranged to contact said clamping jaws for effecting the displacement of said clamping jaws in the first direction away from the second end of said frame.

2. Apparatus, as set forth in claim 1, wherein sliding guides for said sliding carriage are provided on edges of said side walls extending in the first direction.

3. Apparatus, as set forth in claim 2, wherein said sliding guides are formed as sliding rails.

4. Apparatus, as set forth in claim 2, wherein said sliding carriage is located between and is displaceable in the first direction between said side walls and said sliding carriage extends transversely over said sliding guides.

5. Apparatus, as set forth in claim 1, including an elongated slot extending in the first direction in at least one of said side walls, a sliding device for said upsetting pipe guided in the manner of a connecting link is provided in said elongated slot.

6. Apparatus, as set forth in claim 1, wherein said clamping device includes an adjustable stop for limiting the movement of said clamping jaws when the clamping jaws are moved into clamping engagement with the cable.

7. Apparatus, as set forth in claim 1, wherein means cooperates with said clamping jaws for moving the clamping jaws out of clamping engagement with the cable.

8. Apparatus, as set forth in claim 7, wherein said means comprises a spring element and a pin arranged to contact said spring element for displacing said clamping jaws out of clamping engagement.

9. Apparatus, as set forth in claim 1, wherein said clamping jaws and said counter jaws each have facing surfaces extending in the first direction with a plurality of circular arc-shaped recesses located in said surfaces, said articulated levers each having opposite ends located in one recess of said clamping jaw and one recess of said counter jaw, the ends of said articulated levers located within said recesses being rounded in a circular arc-shaped manner corresponding to the configuration of said recesses.

10. Apparatus, as set forth in claim 9, wherein axial pins pivotally support said articulated levers at said clamping jaws and at said counter jaws.

11. Apparatus, as set forth in claim 1, wherein said thrust member comprises a borehole for receiving a central wire of the stranded cable, said borehole extending the first direction and means for adjusting the depth of said borehole.

12. Apparatus, as set forth in claim 11, wherein said means for adjusting the depth of said borehole comprises an adjusting screw.

13. Apparatus, as set forth in claim 1, comprising a holder including a handle and a base with said handle extending outwardly from said frame transversely of the first direction and said base extending outwardly from said frame transversely of the first direction and located on the opposite side of said frame from said handle.

* * * * *